US005978201A

United States Patent [19]

Fujiwara et al.

[11] Patent Number: 5,978,201

[45] Date of Patent: Nov. 2, 1999

[54] DESIGN FOR SOLENOID DRIVING CIRCUIT BASED ON REGULATIONS OF CURRENT RIPPLE AND SOLENOID EFFECTIVE TIME CONSTANT FOR DRIVING KEYS OF A PLAYER PIANO

[75] Inventors: Yuji Fujiwara; Taro Kawabata; Yasuhiko Oba, all of Hamamatsu, Japan

[73] Assignee: Yamaha Corporation, Hamamatsu, Japan

[21] Appl. No.: 09/012,063

[22] Filed: Jan. 22, 1998

[30] Foreign Application Priority Data

Jan. 23, 1997 [JP] Japan ..... 9-010535

[51] Int. Cl.[6] ..... H01H 47/22

[52] U.S. Cl. ..... 361/153; 361/184

[58] Field of Search ..... 361/152, 153, 361/157, 159, 160, 166, 170, 182, 183, 184; 84/744, 745, 19, 20, 21, 22, 23

[56] References Cited

U.S. PATENT DOCUMENTS

| | | | |
|---|---|---|---|
| 4,377,144 | 3/1983 | Takahashi | 123/490 |
| 4,599,674 | 7/1986 | Ishikawa et al. | 361/154 |
| 4,620,260 | 10/1986 | Oshizawa et al. | 361/152 |
| 4,947,283 | 8/1990 | Kono | 361/154 |
| 5,345,181 | 9/1994 | Mantani et al. | 324/546 |

FOREIGN PATENT DOCUMENTS

| | | |
|---|---|---|
| 4-57303 | 2/1992 | Japan . |
| 5-241570 | 9/1993 | Japan . |
| 6-4104 | 1/1994 | Japan . |
| 6-4105 | 1/1994 | Japan . |
| 6-61042 | 3/1994 | Japan . |

*Primary Examiner*—Jeffrey Gaffin
*Attorney, Agent, or Firm*—Graham & James LLP

[57] ABSTRACT

A solenoid driving circuit contains solenoids, each of which is driven to produce a magnetic field for driving each of keys of a player piano. A NPN transistor is provided to allow or block a flow of current across each solenoid. The solenoid is connected between a DC power source for providing a source voltage and a collector of the NPN transistor whose emitter is grounded. A drive signal, which is subjected to pulse-width modulation, is supplied to a base of the NPN transistor, so that the NPN transistor is switched over between ON and OFF. A diode is introduced to provide prescribed forward voltage for attenuation of the current across the solenoid when the NPN transistor is turned OFF. Herein, an anode of the diode is connected to a connection between the solenoid and NPN transistor, while a cathode of the diode is connected to a cathode of a zener diode having prescribed reverse voltage. An anode of the zener diode is connected to the DC power source. An effective time constant of the solenoid is represented in a mathematical form using the forward voltage, reverse voltage and source voltage as well as a real time constant of the solenoid. So, the solenoid driving circuit designed in such a way that the effective time constant of the solenoid is sufficiently small as compared to a maximum value of an operating frequency of the key of the player piano (i.e., action cutoff frequency of the player piano).

11 Claims, 9 Drawing Sheets

DESIGN FOR SOLENOID DRIVING CIRCUIT BASED ON REGULATIONS OF CURRENT RIPPLE AND SOLENOID EFFECTIVE TIME CONSTANT FOR DRIVING KEYS OF A PLAYER PIANO

BACKGROUND OF THE INVENTION

1. Field of the Invention

This invention relates to solenoid driving circuits which drive solenoids, especially solenoids for driving keys of player pianos. This invention is based on patent application No. Hei 9-10535 filed in Japan, the content of which is incorporated herein by reference.

2. Prior Art

FIG. 10 and FIG. 11 show examples of typical configurations of driving circuits which drive solenoids for driving keys of player pianos. Herein, common parts are designated by same numerals in FIG. 10 and FIG. 11.

(A) Driving Circuit using Single Bridge Circuit

The driving circuit of FIG. 10 contains a single bridge circuit, i.e., a bridge circuit which is configured by connecting a solenoid 1 and a diode 3 in parallel. Herein, one end of the solenoid 1 is connected to a collector of a NPN transistor 2. In addition, source voltage V is applied to another end of the solenoid 1. The diode 3 is connected to the solenoid 1 in parallel. When the NPN transistor 2 is turned OFF, the diode 3 forces electric current across the solenoid 1 to circulate the bridge circuit as kickback current. An emitter of the NPN transistor 2 is grounded, while a drive signal PWM is applied to a base of the NPN transistor 2 via a resistor 4.

The drive signal PWM is subjected to pulse-width modulation to establish a duty ratio which corresponds to a target value of an average current which should flow across the solenoid 1. Responding to the timing corresponding to the duty ratio, the NPN transistor 2 is switched over between ON and OFF. In an ON state of the NPN transistor 2, the current due to the source voltage V flows across the solenoid 1. When the NPN transistor 2 is switched over from ON to OFF, the current across the solenoid 1 circulates the bridge circuit as the kickback current, wherein it gradually attenuates. As a result, an average current which coincides with the target value or which approximates the target value flows across the solenoid 1, so a magnetic field is produced to drive a key (not shown) by an intensity of striking which corresponds to the target value.

(B) Driving Circuit using Full Bridge Circuit

The driving circuit of FIG. 11 contains a full bridge circuit which is employed to improve performance in response thereof. The driving circuit of FIG. 11 contains the aforementioned circuit components 1 to 4 shown in FIG. 10. The source voltage V is applied to an emitter of a PNP transistor 5, a collector of which is grounded via a diode 6. Another end of the solenoid 1 is connected to the collector of the PNP transistor 5. Thus, the source voltage V is applied indirectly to one end of the solenoid 1 via the PNP transistor 5. Between the power source and ground, there is provided a series circuit consisting of resistors 7, 8 and a NPN transistor 9. Voltage at a connection of the resistors 7 and 8 is applied to a base of the PNP transistor 5. A drive signal PWM is applied to a base of the NPN transistor 9 via a resistor 10.

Like the aforementioned driving circuit of FIG. 10, the drive signal PWM used in the driving circuit of FIG. 11 is subjected to pulse-width modulation to establish a duty ratio corresponding to a target value of an average current which should flow across the solenoid 1. Responding to the timing corresponding to the duty ratio, the NPN transistors 2, 9 and the PNP transistor 5 are simultaneously switched over between ON and OFF. Under an ON state where all the transistors are turned ON, the current due to the source voltage V flows in a direction as follows:

PNP transistor 5→solenoid 1→NPN transistor 2.

Under an OFF state where all the transistors are turned OFF, the current across the solenoid 1 now flows in a direction as follows:

Diode 6→solenoid 1→diode 3.

Then, the above current finally returns to the power source. Herein, the polarity of the voltage applied to the solenoid 1 under the OFF state is reverse to the polarity under an ON state of the PNP transistor 5. So, the current across the solenoid 1 rapidly attenuates.

Like the aforementioned driving circuit using the single bridge circuit, the driving circuit using the full bridge circuit operates in such a way that a key (not shown) corresponding to the solenoid 1 is struck by an intensity which corresponds to the target value.

Normally, in the design of the solenoid driving circuit, the specification of the solenoid is determined in consideration of the specification for performance of a player piano as well as arrangement space and price of the solenoid. For example, the size of the solenoid should be determined to have a capability of producing a magnetic field whose intensity corresponds to a maximum tone volume in automatic performance. In addition, the size of the solenoid should be determined in such a way that the solenoid can be stored in the arrangement space. To reduce manufacturing cost, the size of the solenoid should be small.

In the solenoid driving circuit using the single bridge circuit shown in FIG. 10, if the size of the solenoid 1 is simply enlarged to increase the maximum magnetic field intensity, a time constant (i.e., real time constant) which is determined by the specification of the solenoid 1 should be increased, so a response speed should become slow. As a result, even if the NPN transistor 2 is switched over to an OFF state, it is hard to attenuate the current across the solenoid 1. This raises a possibility that quick performance to strike keys quickly cannot be regenerated in a sufficient manner. That is, too much increase in size of the solenoid 1 brings too much increase of the real time constant, so there is a possibility that regeneration performance (or playback performance) of the player piano should be lowered.

On the other hand, if the size of the solenoid 1 is reduced to reduce the manufacturing cost, a time constant should become small, so a response speed should be fast. As a result, when the NPN transistor 2 is switched over to an OFF state, the current across the solenoid 1 rapidly attenuates. However, if the size of the solenoid 1 is reduced too small as compared to the period of the drive signal PWM, in other words, if the real time constant of the solenoid 1 is reduced too small, the current ripple which is caused due to the pulse-width modulation is large and is not negligible. So, there is a possibility that the playback performance of the player piano is lowered.

In principle, the aforementioned current ripple can be reduced by increasing the frequency of the drive signal PWM sufficiently. However, too high frequency of the drive signal PWM causes intervals of time of switching of the NPN transistor 2 to be extremely short. This brings an increase in an amount of heating of the NPN transistor 2 and the solenoid 1. In general, the switching element which is capable of suppressing an increase of an amount of heating thereof against an increase of the drive frequency is expensive. Using such an expensive switching element causes an increase of the manufacturing cost. Even if the response speed of the solenoid 1 is made fast, it is impossible to reduce a rise time and a fall time to zero. For this reason, as the frequency of the drive signal PWM becomes higher, a loss which is caused due to the switching of the NPN transistor 2 becomes larger. So, there is a problem that a drive efficiency is lowered.

Even if the aforementioned problem is avoided through the trial and error, it is not considered to change the real time constant of the solenoid 1 which is determined based on the aforementioned condition. So, there is a possibility that distribution of parameters such as the real time constant of the solenoid 1 and the frequency of the drive signals PWM becomes out of balance. Such an imbalance in distribution of the parameters may cause a situation where a sufficient margin is provided for one parameter while substantially no margin is provided for another parameter. In such a situation, if the parameters are changed in response to a change of the specification or if dispersion occurs on parts in manufacturing processes, harmonization between elements of the driving circuit may go wrong. So, there is a possibility that the player piano cannot satisfy the required specification of the playback performance. In addition, margins of the parameters are not grasped in a quantitative manner. So, it is not possible to grasp an amount of imbalance between the parameters in the design.

On the other hand, the driving circuit using the full bridge circuit operates in such a manner that when the NPN transistor 2 is switched over to an OFF state, back electromotive force whose level is identical to the source voltage V is applied to the solenoid 1 so that residual current of the solenoid 1 rapidly attenuates. So, even if the real time constant of the solenoid 1 becomes large, an "effective" time constant of the solenoid 1 does not become large. Thus, it is possible to avoid reduction of the playback performance of the player piano.

The effective time constant of the solenoid 1 univocally depends on the real time constant. In addition, the real time constant of the solenoid 1 is determined based on the aforementioned condition. Therefore, like the aforementioned driving circuit using the single bridge circuit, the driving circuit using the full bridge circuit may suffer from a problem that distribution of the parameters goes out of balance. In addition, the driving circuit using the full bridge circuit is not designed to consider margins of the parameters in a quantitative manner as well.

In general, the current ripple caused by the pulse-width modulation is relatively large. This causes a problem that electromagnetic noise which may badly affect operation of the driving circuit is caused by the above current ripple. In addition, the large electromagnetic noise may induce mechanical noise in audible level because of the resonance. This is a cause of the reduction of the playback performance (e.g., sound quality) of the player piano. The aforementioned problems are commonly shared by the driving circuits in which back electromotive force applied to the solenoid is limited to be substantially identical to the source voltage.

It is obvious from FIG. 11 that circuit elements of the driving circuit using the full bridge circuit are required for each node (e.g., each key). Therefore, there is a problem that employment of the driving circuit of FIG. 11 brings an increase of the manufacturing cost. The driving circuit using the single bridge circuit is capable of selecting, normally, one of 256-stage values set between 0% and 100% as the duty ratio for the drive signal PWM. On the other hand, the driving circuit using the full bridge circuit has a property that a turn-OFF time is short as compared to a turn-ON time. For this reason, the driving circuit using the full bridge circuit is capable of selecting one of only 128-stage values substantially set between 50% and 100% as the duty ratio. In short, the driving circuit using the full bridge circuit suffers from a drawback corresponding to low resolution of the pulse-width modulation.

After all, the conventional driving circuits are designed by engineers through the trial and error. So, the design of the conventional driving circuits requires a large amount of labor and much time as well as much cost. Because the effective time constant of the solenoid univocally depends on the real time constant, distribution of the parameters goes out of balance. In addition, margins of the parameters are not grasped in a quantitative manner, so there is a possibility that the engineers should design the driving circuits having imbalance in distribution of the parameters.

SUMMARY OF THE INVENTION

It is an object of the invention to provide a solenoid driving circuit with high playback performance which can be designed by quantitatively grasping margins of parameters to provide an appropriate distribution balance of parameters with ease.

A solenoid driving circuit of this invention is designed using a simple set of circuit elements, i.e., a solenoid, a NPN transistor, a diode and a zener diode. The solenoid driving circuit contains multiple solenoids, each of which is driven to produce a magnetic field for driving each of keys of a player piano. The NPN transistor is provided to allow or block a flow of current across each solenoid. The solenoid is connected between a DC power source for providing a source voltage and a collector of the NPN transistor whose emitter is grounded. A drive signal, which is subjected to pulse-width modulation, is supplied to a base of the NPN transistor, so that the NPN transistor is switched over between ON and OFF. The diode having prescribed forward voltage is provided for attenuation of the current across the solenoid when the NPN transistor is turned OFF. Herein, an anode of the diode is connected to a connection between the solenoid and NPN transistor, while a cathode of the diode is connected to a cathode of the zener diode having prescribed reverse voltage. An anode of the zener diode is connected to the DC power source.

An effective time constant of the solenoid is represented in a mathematical form using the forward voltage, reverse voltage and source voltage as well as a real time constant of the solenoid. So, the solenoid driving circuit is designed in such a way that the effective time constant of the solenoid is sufficiently small as compared to a maximum value of an operating frequency of the key of the player piano (i.e., action cutoff frequency of the player piano). In addition, a current ripple amplitude corresponding to a difference between the maximum value and minimum value in ratio of current ripple is represented using the forward voltage, reverse voltage, source voltage and real time constant of the solenoid as well as resistance of the solenoid and a period of the drive signal. So, the solenoid driving circuit is designed in such a way that the current ripple amplitude belongs to an allowable range.

Thus, it is possible to design the solenoid driving circuit with low noise and low cost as well as with a simple configuration. In addition, it is possible to design the solenoid driving circuit which is capable of providing high playback performance for the player piano.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Now, a description will be given with respect to the preferred embodiment of the invention under a precondition that a solenoid for driving a key of a player piano is assumed as an equivalence of a first-order low frequency filter consisting of a coil and a resistor.

1. Configuration

Figure 1:
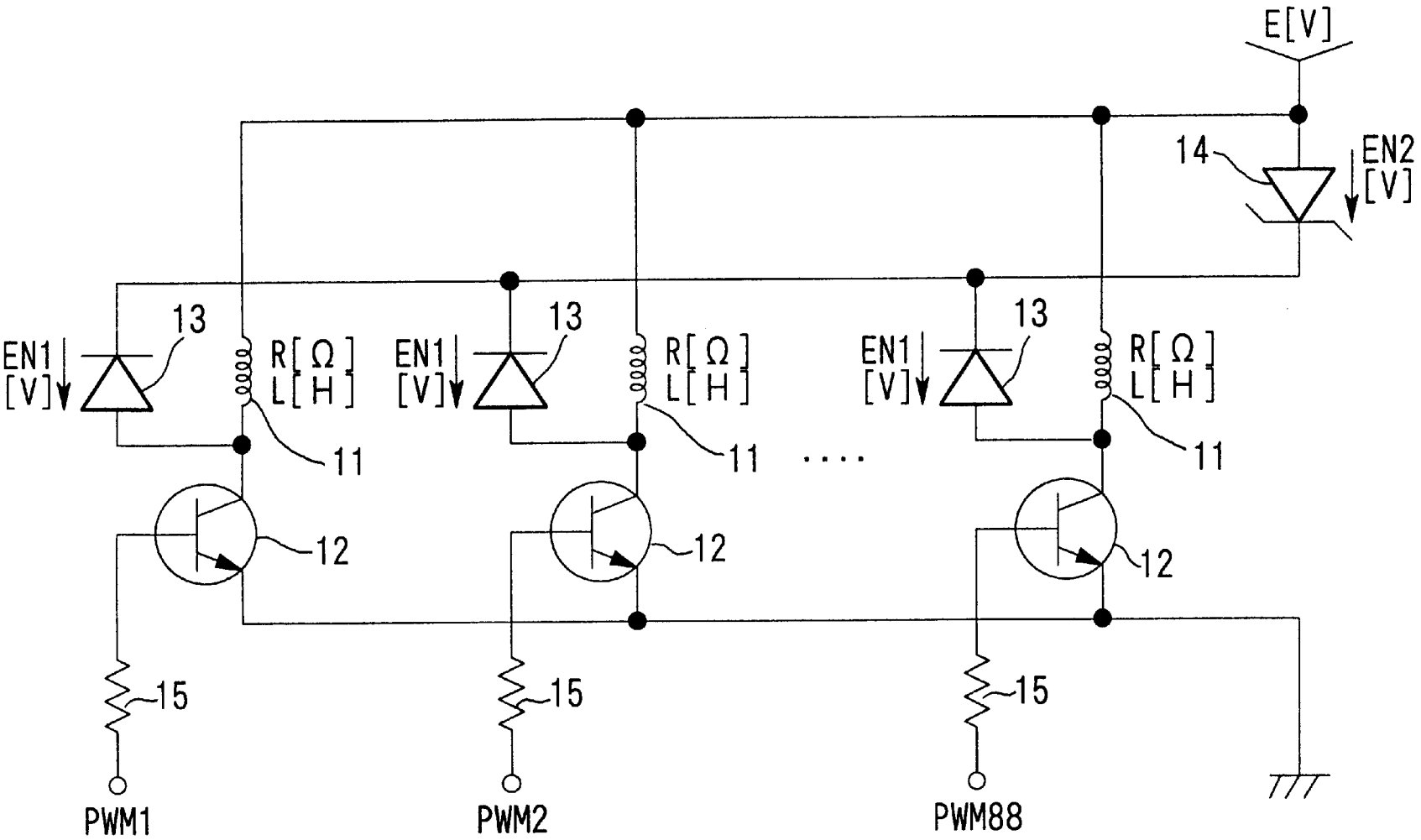
FIG. 1 is a circuit diagram showing a configuration of a solenoid driving circuit in accordance with an embodiment of the invention.

FIG. 1 is a circuit diagram showing a circuit configuration of a solenoid driving circuit in accordance with one embodiment of the invention. Herein, the solenoid driving circuit of FIG. 1 contains solenoids for driving keys of the player piano respectively.

In FIG. 1, a numeral '11' represents each solenoid consisting of a coil and a resistor. There are provided eighty-eight solenoids which correspond to eighty-eight keys of the player piano respectively. A numeral '12' represents each NPN transistor such as a FET (an abbreviation for "Field Effect Transistor"). The NPN transistors are connected to the solenoids respectively. In each NPN transistor 12, an emitter is grounded while a collector is connected to one end of each solenoid 11. DC source voltage E is applied to another end of each solenoid 11 so as to produce a magnetic field. A numeral '13' represents each diode corresponding to a P-N junction. Herein, P side (i.e., anode) of the diode 13 is connected to one end of the solenoid 11. A numeral '14' designates a zener diode corresponding to a P-N junction. Herein, N side (i.e., cathode) of the zener diode 14 is connected to N side of the diode 13, while the DC source voltage E is applied to P side of the zener diode 14. A numeral '15' represents a resistor whose resistance is determined in advance. One end of the resistor 15 is connected to a base of the NPN transistor 12, while a drive signal is supplied to another end of the resistor 15. Herein, there are provided eighty-eight drive signals which are designated by symbols PWM1 to PWM88 respectively.

As described before, the solenoid 11 is assumed as an equivalence of a first-order low frequency filter which consists of a coil and a resistor. Herein, the solenoid 11 has resistance R [Ω], self-inductance L [H], real time constant τ[s] determined by the specification, and cutoff frequency fcSOL [Hz]. In addition, the diode 13 has forward voltage ENI [V] while the zener diode 14 has reverse voltage EN2 [V]. An upper-limit value in frequency of a piano action which contributes to operation defined by a certain frequency band is called an action cutoff frequency, which is designated by a symbol "fca" [Hz]. Each of frequencies of the drive signals PWM1 to PWM88 is called a PWM frequency, which is designated by a symbol "fpwm" [Hz]. In addition, a symbol "T" [s] represents a period of the drive signal PWM while a symbol "d" represents a duty ratio of the drive signal PWM.

The aforementioned parameters are set by the design process to meet a prescribed relationship, which will be described later.

2. Basic Operation

Next, a description will be given with respect to the basic operation of the solenoid driving circuit of the present embodiment. Herein, the description will be given with respect to the basic operation only because the concrete operation of the solenoid driving circuit is changeable in response to the content of the design. In addition, the operation of the circuit is common with respect to each of the keys, so the basic operation of the circuit will be described with regard to one key, which is any one of the eighty-eight keys which corresponds to any one of the drive signals PWM1 to PWM88. So, the following description uses an expression of "drive signal PWM" instead of using an expression of "drive signal PWM1" etc.

In FIG. 1, the drive signal PWM is subjected to pulse-width modulation to establish the duty ratio d which follows a target value of an average current which should flow across the solenoid 11. By the timing corresponding to the duty ratio d, the NPN transistor 12 is switched over between ON and OFF. In an ON state where the NPN transistor 12 is turned ON, current caused by the DC source voltage E flows across the solenoid 11. When the NPN transistor 12 is switched over to an OFF state, the polarity of the voltage applied to the solenoid 11 is made reverse to the polarity of the voltage which is applied to the solenoid 11 under the ON state of the NPN transistor 12. So, the current across the solenoid 11 now attenuates at a speed which is suited to magnitude of a reverse applied voltage EN. Herein, the reverse applied voltage EN corresponds to a sum of the forward voltage EN1 of the diode 13 and the reverse voltage EN2 of the zener diode 14, the details of which will be described later. By repeating the above operations in response to the drive signal PWM, an average current which coincides with a target value or which approximates a target value flows across the solenoid 11. Thus, it is possible to produce a magnetic field which drives the key by an intensity of force corresponding to the target value.

3. Design Process

In the solenoid driving circuit of the present embodiment, characteristics of the solenoids 11 are determined, as similar to those of the conventional circuits, in consideration of the specification of performance (e.g., maximum magnetic field intensity) of the player piano as well as the arrangement space and price thereof. Different from the solenoid 1 of the conventional circuits, the solenoid 11 of the present embodiment cannot be specified with respect to an effective time constant even if a real time constant $\tau$ is determined.

Figure 2:
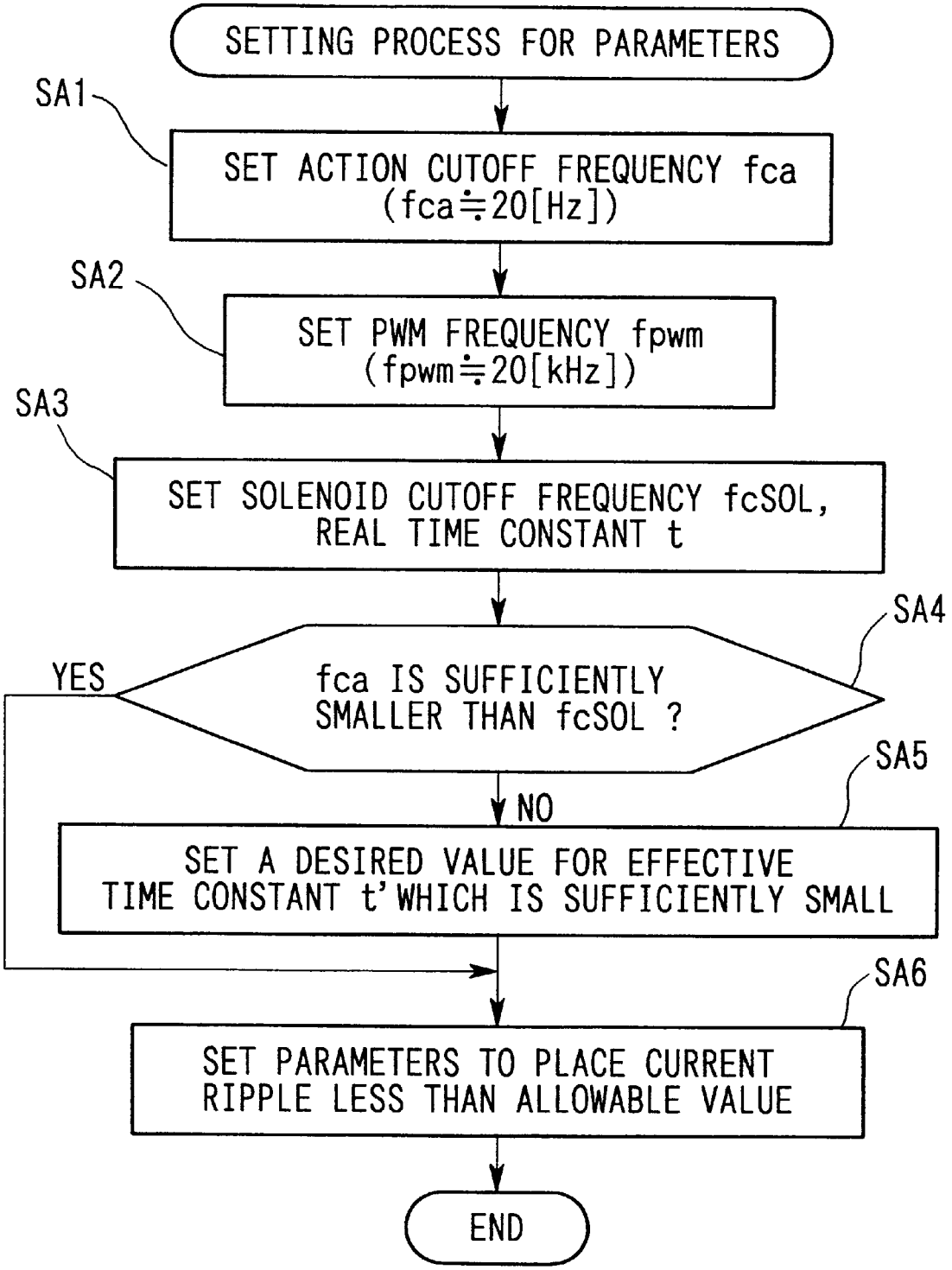
FIG. 2 is a flowchart showing an example of procedures for setting process of parameters which are set when designing the solenoid driving circuit of FIG. 1.

FIG. 2 is a flowchart showing an example of procedures for the design of the solenoid driving circuit of the present embodiment with respect to the setting of parameters. Now, a description will be given with respect to the procedures for the setting of the parameters in conjunction with FIG. 2.

In step SA1, an action cutoff frequency fca is determined based on the specification of performance of the player piano. The action cutoff frequency fca indicates a maximum speed of high-speed performance such as the quick performance to strike keys quickly. This action cutoff frequency depends on the required specification of performance of the player piano. Normally, the action cutoff frequency of 20 [Hz] or so may meet the required specification of performance of the player piano. The present embodiment sets the action cutoff frequency fca as follows:

$$fca=20\ [\mathrm{Hz}].$$

In step SA2, the present embodiment determines a PWM frequency fpwm. Basically, it is possible to arbitrarily set the PWM frequency fpwm. However, if the PWM frequency fpwm is too small, there is a possibility that mechanical noise due to voltage variations which occur by periods corresponding to the PWM frequency comes into an audible band. In contrast, if the PWM frequency is too large, an increase occurs on an amount of heating of the NPN transistor 12 as well as an amount of heating (or core loss) of the solenoid 11. For this reason, the PWM frequency should be limited to frequency values around 20 [kHz]. So, the present embodiment sets the PWM frequency as follows:

$$fpwm=20\ [\mathrm{kHz}]$$

The characteristics of the solenoid 11 (i.e., R [Ω], L [H]) are determined in consideration of the specification of performance of the player piano (e.g., maximum magnetic field intensity) as well as the arrangement space and price of the solenoid. In step SA3, a real time constant $\tau$ and a cutoff frequency fcSOL are calculated on the basis of the characteristics of the solenoid 11. Concretely speaking, the calculations use equations as follows:

$$\tau=L/R$$

$$fcSOL=1/(2\pi\tau)$$

In step SA4, a comparison is performed between the action cutoff frequency fca which is set by the step SA1 and the cutoff frequency fcSOL of the solenoid 11 which is calculated by the step SA3. Herein, a decision is made as to whether the action cutoff frequency fca is sufficiently smaller than the cutoff frequency fcSOL of the solenoid 11 or not. The basis for the decision is arbitrary. Herein, the decision that the action cutoff frequency fca is sufficiently smaller than the cutoff frequency fcSOL is established if a phase delay of the solenoid 11 against the piano action is within −5°.

Figure 3A:
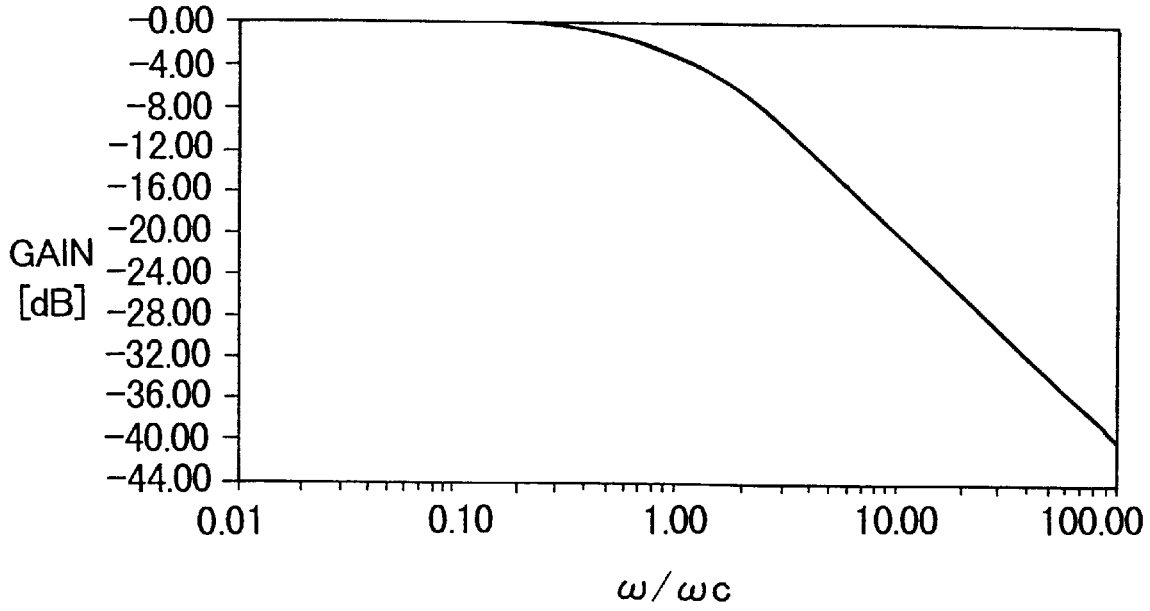
FIG. 3A is a graph showing a gain Bode diagram for a general-use first-order low frequency filter.
Figure 3B:
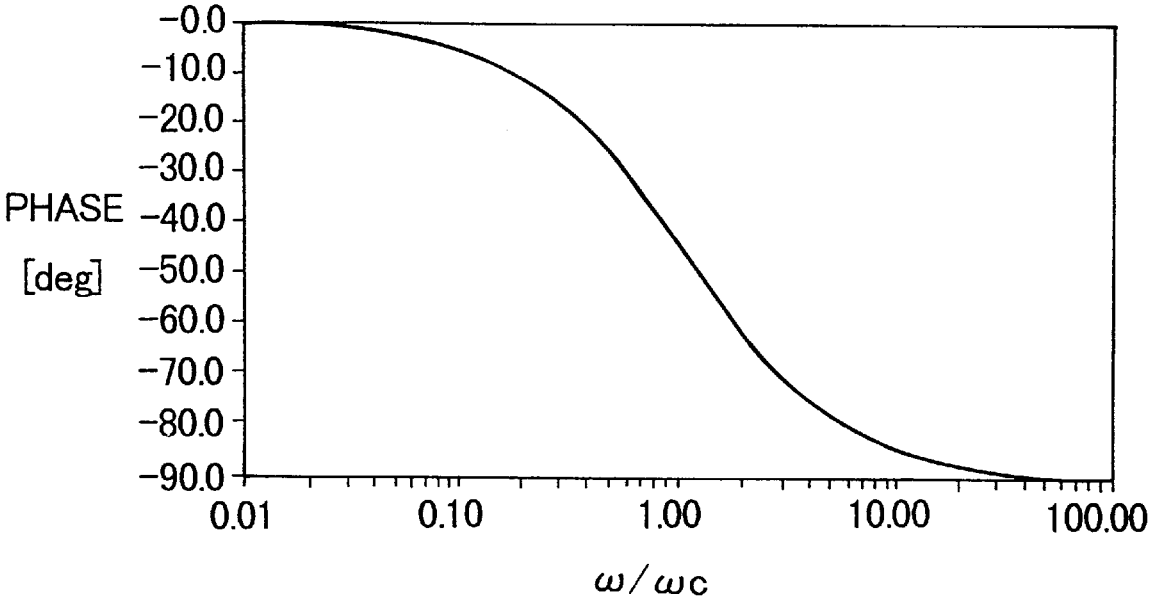
FIG. 3B is a graph showing a phase Bode diagram for a general-use first-order low frequency filter.

FIG. 3A shows a gain Bode diagram while FIG. 3B shows a phase Bode diagram. Those diagrams are provided with respect to the frequency characteristic of the general-use first-order low frequency filter. Based on the contents of the diagrams, it is possible to perform the aforementioned decision. In FIG. 3A and FIG. 3B, ωc is a cutoff angular velocity which corresponds to the cutoff frequency of the low frequency filter, so a horizontal axis (ω/ωc) represents a ratio of an angular velocity ω against the cutoff angular velocity ωc. It is obvious from FIG. 3B that ω/ωc should be less than 0.1 in order to place the phase delay within −5°. Such a relationship is represented by an inequality regarding the solenoid 11, as follows:

$$fca/fcSOL<0.1$$

To establish the above inequality, the cutoff frequency fcSOL of the solenoid 11 should be greater than the action cutoff frequency fca 10 times or more. Because the present embodiment sets the action cutoff frequency at 20 [Hz], the cutoff frequency fcSOL of the solenoid 11 should exceed 200 [Hz]. Using the cutoff frequency fcSOL, the real time constant $\tau$ is represented by an equation as follows:

$$\tau=1/(2\pi fcSOL)$$

In order that the cutoff frequency fcSOL exceeds 200 [Hz], it is necessary to establish a relationship represented by an inequality as follows:

$$\tau<0.8\ [\mathrm{ms}]$$

By making a decision as to whether the above relationship is established or not, it is possible to make a decision as to whether the action cutoff frequency fca is sufficiently smaller than the cutoff frequency fcSOL of the solenoid 11. If a result of the decision is "NO", the present embodiment proceeds to step SAS. If "YES", the present embodiment directly proceeds to step SA6 without executing the step SA5.

By the way, the reverse voltage EN2 of the zener diode 14 is not set in the decision of the step SA4. In order to calculate an effective time constant $\tau'$ for the solenoid driving circuit as a whole, it is assumed that the reverse voltage EN2 is zero [V]. Like the aforementioned conventional driving circuit using the single bridge circuit, the real time constant $\tau$ of the solenoid 11 coincides with the effective time constant $\tau'$ for the solenoid driving circuit as a whole in the present embodiment. In addition, it is confirmed in step SA4 that the real time constant $\tau$ is not sufficiently small. So, it can be said that the effective time constant $\tau'$ is not sufficiently small.

Figure 4:
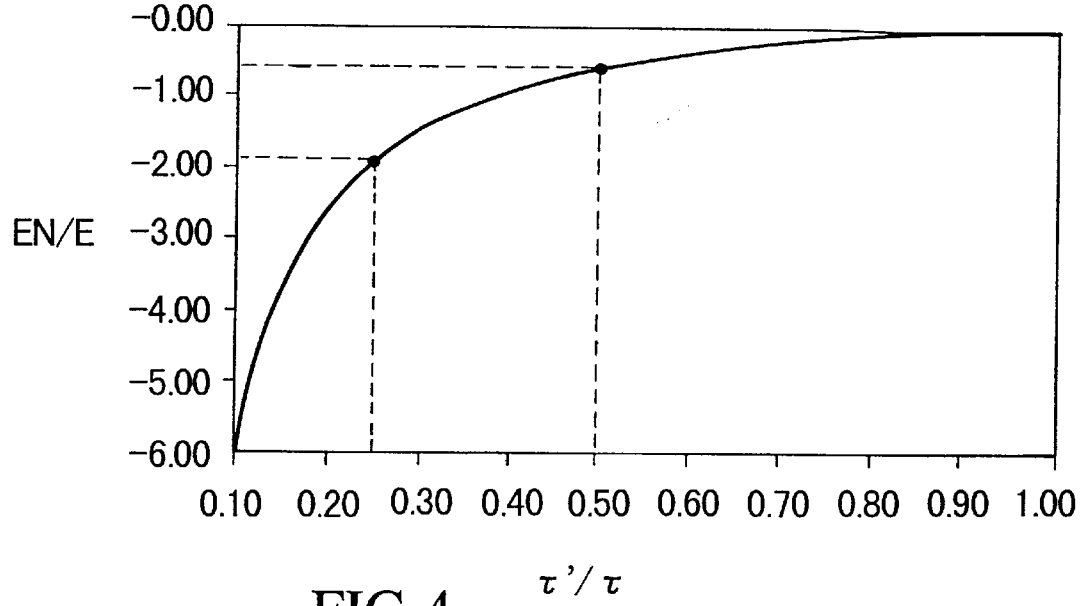
FIG. 4 is a graph showing a relationship between an effective time constant τ' and clip voltage EN in the solenoid driving circuit of FIG. 1.

It is shown in FIG. 4 that the effective time constant $\tau'$ changes in response to a ratio of a clip voltage EN against the DC source voltage E. Incidentally, FIG. 4 is a graph showing a relationship between the effective time constant $\tau'$ and clip voltage EN in the solenoid driving circuit of the present embodiment. Herein, the clip voltage EN meets a relationship represented by an equation as follows:

$$EN=EN1+EN2$$

According to FIG. 4, EN/E becomes zero in the case where $\tau'/\tau$ is 1.00. This indicates that the clip voltage EN should be zero in order to coincide the effective time constant τ' with the real time constant τ. In order to coincide the effective time constant τ' with ½ of the real time constant τ, the clip voltage EN should be set identical to −0.7 times as much as the DC source voltage E or so. In order to coincide the effective time constant τ' with ¼ of the real time constant τ, the clip voltage EN should be set identical to −1.9 times as much as the DC source voltage E or so. As described above, by changing the clip voltage EN against the DC source voltage E, it is possible to obtain a desired effective time constant τ'.

Figure 5:
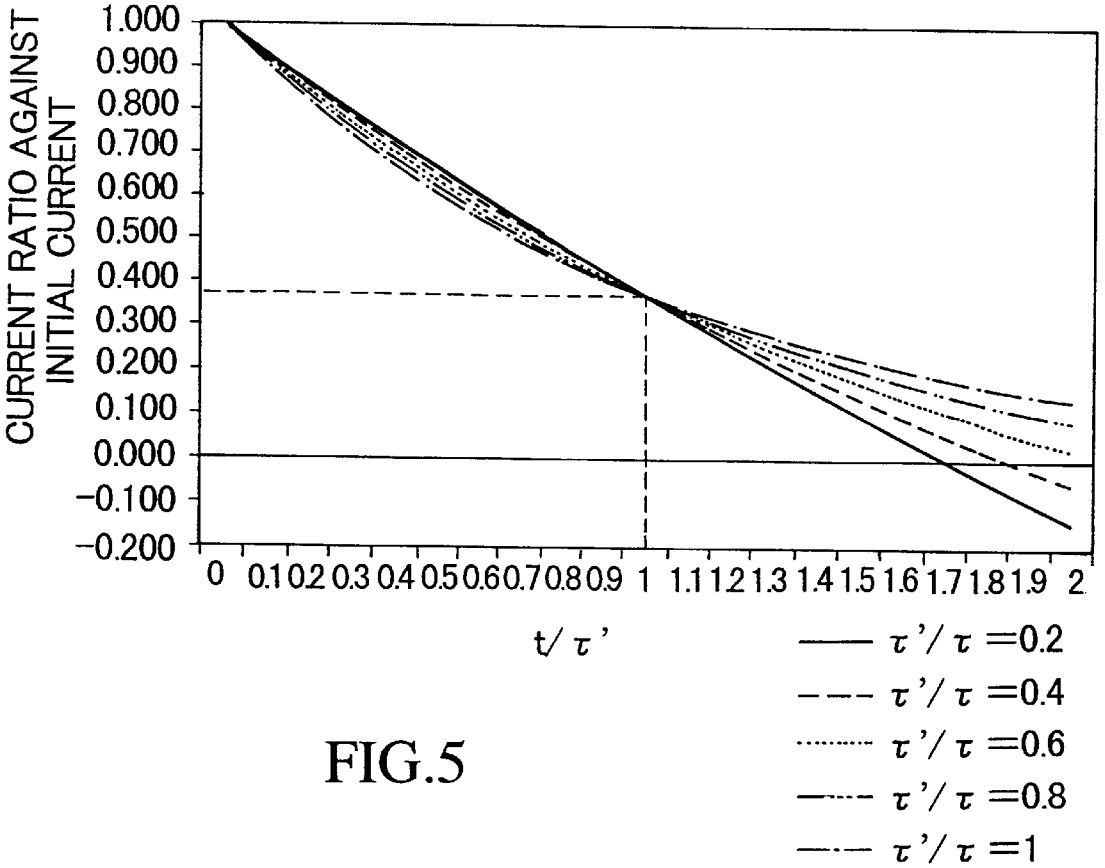
FIG. 5 is a graph showing characteristic curves representing manners of attenuation of residual current across a solenoid in a turn-OFF event of the solenoid driving circuit of FIG. 1.

Next, a description will be given with respect to a relationship between the effective time constant τ' and real time constant τ with reference to FIG. 5. FIG. 5 is a graph showing a manner of attenuation of the residual current across the solenoid 11 in a turn-OFF event of the solenoid driving circuit. Herein, five characteristic curves are drawn respectively with respect to five kinds of the value of τ'/τ as well as the effective time constant τ'. A vertical axis of FIG. 5 represents a current ratio of residual current against initial current which flows across the solenoid 11 at the turn-OFF timing of the solenoid driving circuit. In the case of τ'/τ=1, the current ratio is decreased to 0.37 at a time when the effective time constant τ' elapses from the turn-OFF timing; thereafter, the current ratio is gradually decreased to zero. In the case of τ'/τ=0.2, the current ratio is decreased to 0.37 at a time when the effective time constant τ' elapses from the turn-OFF timing; thereafter, the current ratio is asymptotically lowered to −1. FIG. 5 shows that the five characteristic curves do not coincide with each other. This means that different values of the real time constant τ provide different manners of attenuation of the current flowing across the solenoid 11 even if the effective time constant τ' remains the same. Namely, the effective time constant τ' does not strictly define the manner of attenuation of the residual current across the solenoid 11.

The effective time constant τ' defines that a degree of attenuation of the current flowing across the solenoid 11 is less than a prescribed value at a time when the effective time constant τ' elapses from the turn-OFF timing. Herein, the prescribed value corresponds to a degree of attenuation at a time when the effective time constant τ' (or real time constant τ) elapses from the turn-OFF timing under a state where the effective time constant τ' coincides with the real time constant τ, in other words, under a state where the clip voltage EN is zero. According to FIG. 5, the above degree of attenuation corresponds to 0.37 or so.

A time which is required to decrease the residual current across the solenoid 11 to zero after the turn-OFF timing becomes shorter as the real time constant τ becomes larger while the effective time constant τ' remains the same. So, if the aforementioned step SA4 makes a decision that the real time constant τ does not meet the aforementioned relationship (e.g., τ<0.8 [ms]), it is possible to actualize a sufficient response speed if the effective time constant τ' meets the relationship. For this reason, the present embodiment sets the effective time constant τ' to meet the relationship in step SA5. Incidentally, the effective time constant τ' is defined by an equation as follows:

$$\tau' < -\ln\left(\frac{\frac{E}{e} + EN1 + EN2}{E + EN1 + EN2}\right)\cdot\tau \qquad \text{[Equation 1]}$$

In the above equation, the real time constant τ and DC source voltage E are set in advance. Thus, by setting the clip voltage EN based on FIG. 4, in other words, by setting the forward voltage EN1 of the diode 13 and the reverse voltage EN2 of the zener diode 14 based on FIG. 4, it is possible to obtain a desired value of the effective time constant τ'.

The present embodiment proceeds to step SA6 when the step SA4 makes a decision that the real time constant τ is sufficiently small, or when the step SA5 sets a sufficiently small value for the effective time constant τ'. In step SA6, the present embodiment sets parameters to reduce current ripple caused by the drive signal PWM to be less than an allowable value.

Figure 6A:
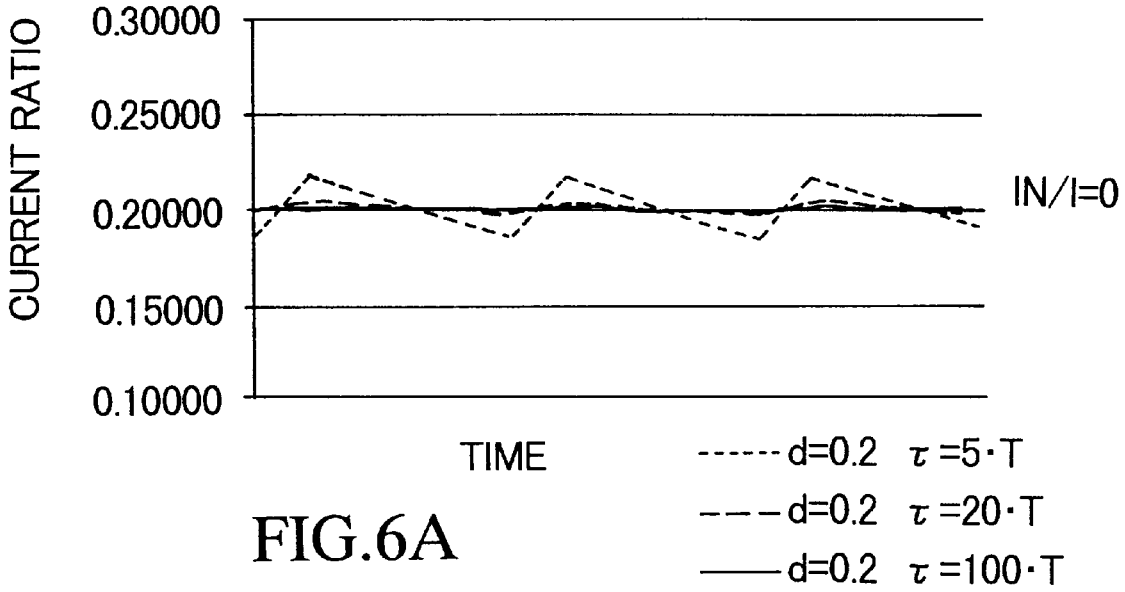
FIG. 6A and FIG. 6B are graphs each of which shows time-related variations in ratio of current ripple against current across the solenoid.
Figure 6B:
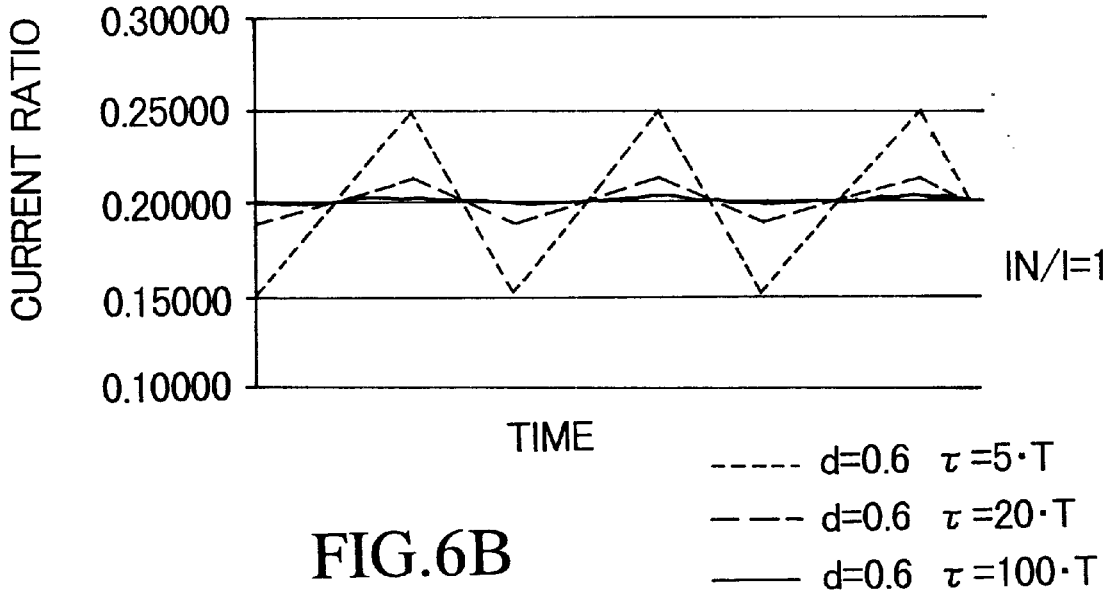

Next, a description will be given with respect to a relationship between the current ripple caused by the drive signal PWM and parameters with reference to FIG. 6A and FIG. 6B. FIG. 6A and FIG. 6B are graphs each of which shows time-related variations in current ratio of current ripple against the current across the solenoid 11. FIG. 6A shows the current ratio in the case of IN/I=0 while FIG. 6B shows the current ratio in the case of IN/I=1. Herein, IN/I indicates a ratio of clip current, wherein symbols I and IN are represented by equations as follows:

$$I=E/R$$

$$\mathrm{IN}=(EN1+EN2)/R$$

Therefore, IN/I is equivalent to "(EN1+EN2)/E". Incidentally, waveforms shown in FIGS. 6A and 6B are created with respect to the case where an effective duty ratio d' is set at 0.2. The effective duty ratio d' corresponds to a ratio of the actual current across the solenoid 11 against the reference current which flows across the solenoid 11 when the duty ratio d of the drive signal PWM is 1. In other words, the effective duty ratio d' corresponds to a value of the average current across the solenoid 11. By the way, FIG. 6A is provided with respect to d=0.2 while FIG. 6B is provided with respect to d=0.6. The reason why different duty ratios are used for FIG. 6A and FIG. 6B respectively is to establish coincidence of the effective duty ratio d' between FIG. 6A and FIG. 6B. As IN/I becomes large, an attenuation speed to attenuate residual current which is residual in the solenoid 11 at the turn-OFF timing becomes larger (or faster). So, in the case where IN/I is not zero, it is impossible to provide a flow of an average current whose value is identical to that for the case of IN/I=0 if the duty ratio is not increased.

It can be understood from FIG. 6A and FIG. 6B that as the real time constant τ becomes large as compared to a period T of the drive signal PWM, a difference between a maximum value and a minimum value in ratio of current ripple (called "current ripple amplitude ip-p") becomes small. It can be understood by a comparison between FIG. 6A and FIG. 6B that as IN/I becomes small (in other words, as EN/E becomes small), the current ripple amplitude ip-p becomes small. An increase of the current ripple amplitude ip-p brings occurrence of mechanical noise as well as complication of the design. To avoid such problems, the current ripple amplitude ip-p should be small. However, if extreme values are used for the parameters to reduce the current ripple amplitude ip-p, a balance of distribution of the parameters may be deteriorated. So, the present embodiment sets the parameters such that the current ripple amplitude ip-p is identical to a prescribed value or less. Incidentally, if the period T is represented by an equation of $$T=1/fpwm,$$

the current ripple amplitude ip-p regarding the ratio of current ripple is represented by an equation as follows:

$$i_{p-p} = \frac{e^{\frac{T}{\tau}} - e^{\frac{T(1-d)}{\tau}} - e^{\frac{T\cdot d}{\tau}} + 1}{e^{\frac{T}{\tau}} - 1} \cdot (I + IN) \quad \text{[Equation 2]}$$

According to the above equation, the period T of the drive signal PWM (i.e., frequency fpwm), duty ratio d, real time constant τ of the solenoid 11, clip current IN (i.e., the forward voltage EN1 of the diode 13 plus the reverse voltage EN2 of the zener diode 14), and DC source current I (i.e., the DC source voltage E and resistance R of the solenoid 11) are provided as the parameters which are variable to coincide the current ripple amplitude ip-p with the prescribed value.

For example, under the condition where the DC source current I is identical to the clip current IN, in order to suppress the current ripple amplitude ip-p in ratio of current ripple to be less than 0.024 (i.e., 2.4%) when the duty ratio d is 0.2, the present embodiment recommends to employ the solenoid whose real time constant τ meets a condition represented by an inequality as follows $$\tau > 20 \cdot T$$

Namely, the characteristics of the solenoid 11 are determined in consideration of the specification of performance of the player piano, arrangement space and price as well as the aforementioned condition.

It is obvious from the equation 2 that the current ripple amplitude ip-p in ratio of current ripple becomes maximal when the duty ratio d is 0.5, regardless of a value of EN/E. When the duty ratio is 0.5, the aforementioned equation 2 is rewritten as follows:

$$i_{p-p} = \frac{e^{\frac{T}{\tau}} - 2e^{\frac{0.5T}{\tau}} + 1}{e^{\frac{T}{\tau}} - 1} \cdot \frac{E + EN1 + EN2}{R} \quad \text{[Equation 3]}$$

In addition, it is described before that if EN/E is not zero, the effective duty ratio d' differs even if the duty ratio d remains the same. A ripple-maximizing effective duty ratio d'max is established when the current ripple becomes maximal. The ripple-maximizing effective duty ratio d'max in the case where EN/E is zero (see FIG. 6A) is different from that in the case where EN/E is not zero (see FIG. 6B).

Figure 7:
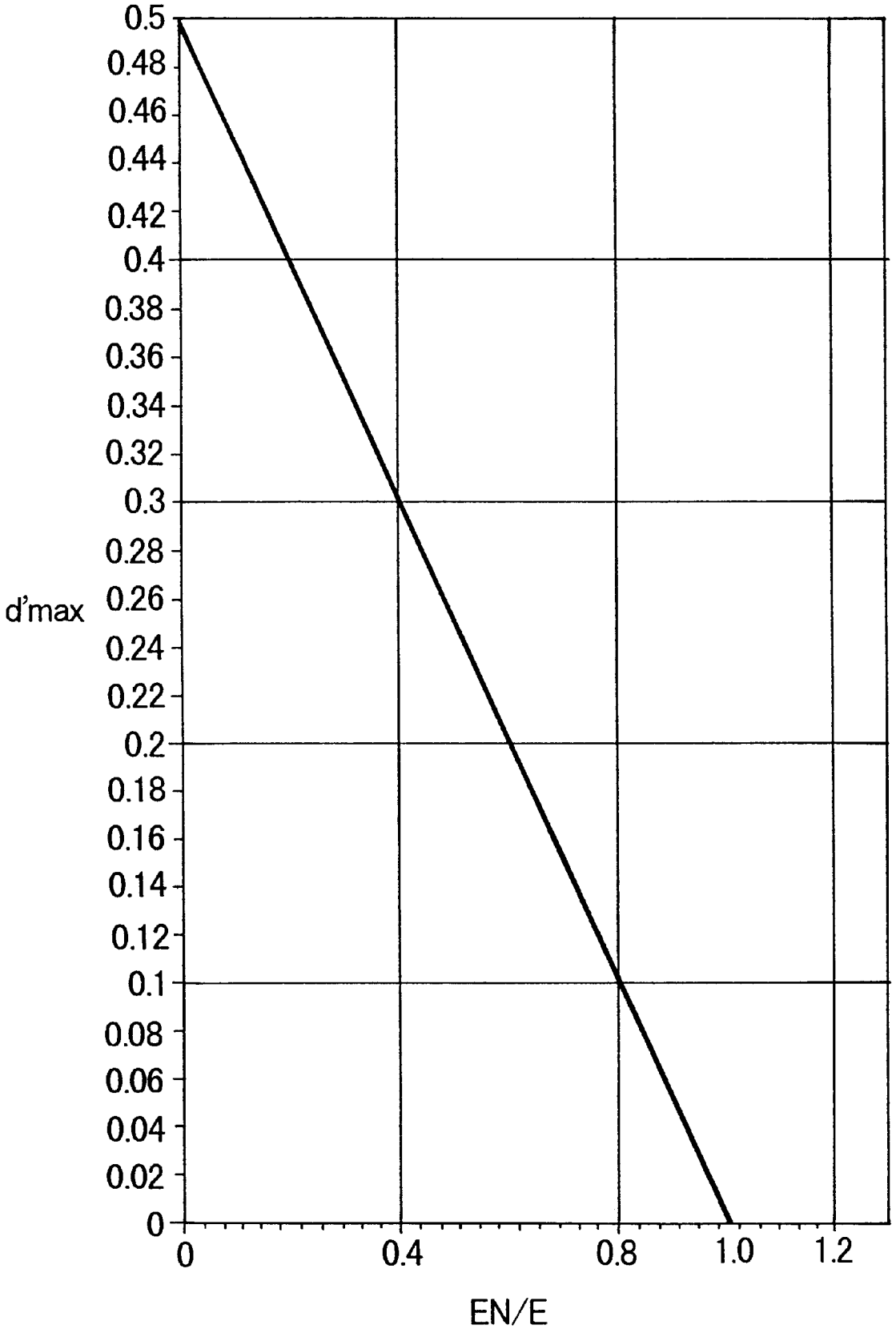
FIG. 7 is a graph showing a characteristic of a maximum-ripple effective duty ratio d'max against EN/E.

FIG. 7 is a graph showing a characteristic of the ripple-maximizing effective duty ratio d'max against EN/E. Herein, as EN/E is increased more, the ripple-maximizing effective duty ratio d'max is decreased more. The effective duty ratio d' corresponds to a value of the average current across the solenoid 11. For this reason, when the effective duty ratio d' becomes small, a tone volume becomes small as well. That is, as EN/E is increased, the current ripple amplitude ip-p in ratio of current ripple becomes maximal with respect to a smaller tone volume. As described before, if the current ripple amplitude ip-p is large, there is a possibility that audible noise occurs. In addition, the timing of occurrence of the audible noise corresponds a time when the sound of the player piano is relatively quiet. This is not preferable in an aspect that the player piano should secure a certain level of playback performance. In short, EN/E should be suppressed small in order to secure the certain level of the playback performance of the player piano.

4. Conclusion

As described heretofore, the present embodiment is designed to employ the circuit configuration of FIG. 1 that the effective time constant τ' of the solenoid 11 which greatly affects the playback performance of the player piano is made independently of the real time constant τ of the solenoid 11. Thus, it is possible to improve a degree of freedom in design of the solenoid driving circuit, while it is possible to actualize high playback performance of the player piano. In addition, the present embodiment is designed in such a way that the relationship between the parameters is defined by the aforementioned equation 1. Thus, it is possible to proceed with the design of the solenoid driving circuit while grasping margins of the parameters in a quantitative manner. In other words, it is possible to provide a relatively high degree of allowance, regardless of design changes and dispersion of parts in manufacturing. Further, the present embodiment is capable of evaluating the cause of reduction of the playback performance in connection with the distribution balance of the parameters. So, it is possible to correct the distribution balance of the parameters to be an appropriate one with ease, while it is possible to actualize the solenoid driving circuit having low noise or appropriate level of noise. Furthermore, the present embodiment is designed such that the zener diode 14 is provided commonly for the keys of the player piano. So, as compared with the conventional driving circuit using the full bridge circuit, it is possible to simplify the circuit configuration of the solenoid driving circuit, while it is possible to actualize the solenoid driving circuit whose manufacturing cost is relatively low.

5. Modification

Figure 8B:
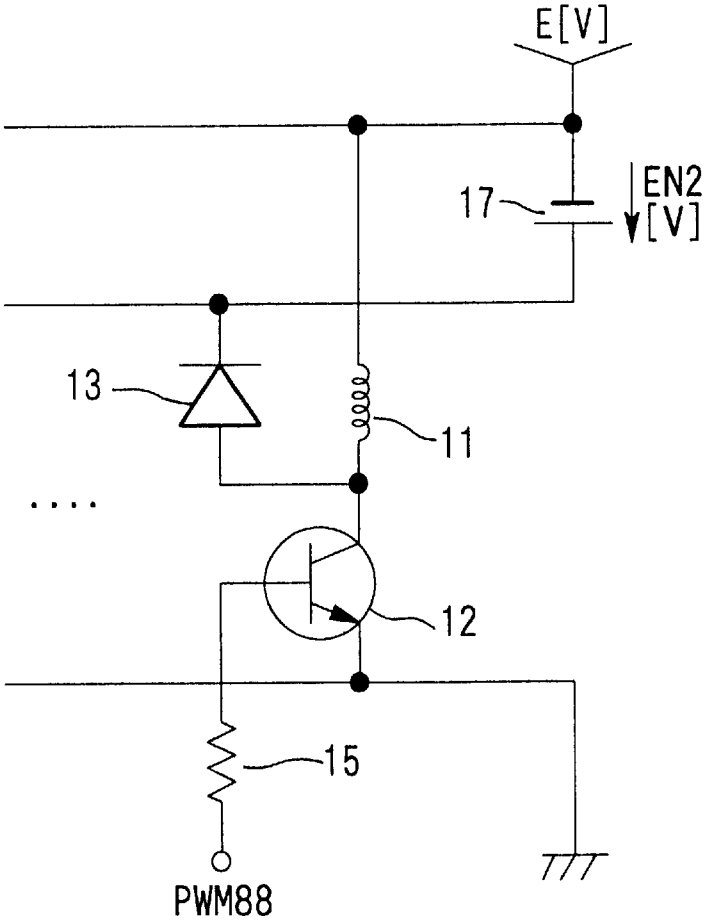
FIG. 8B is a circuit diagram showing a selected part of a solenoid driving circuit in accordance with a second modified example.
Figure 8A:
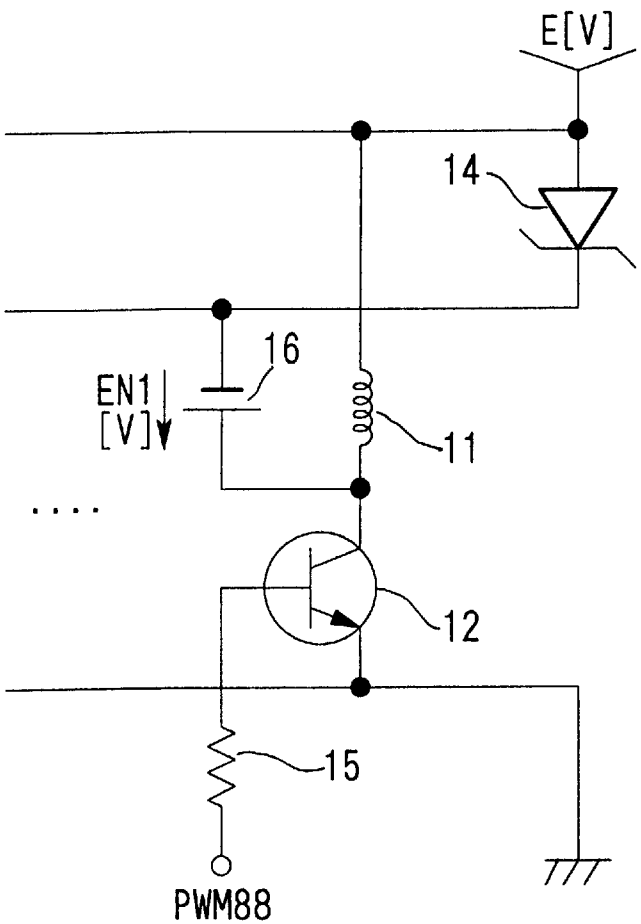
FIG. 8A is a circuit diagram showing a selected part of a solenoid driving circuit in accordance with a first modified example.

The present embodiment uses the diode 13 and the zener diode 14 as first and second voltage defining elements which are essential circuit elements for the solenoid driving circuit of this invention. Of course, the first and second voltage defining elements are not limited to those diodes. For example, as shown in FIG. 8A, it is possible to use a DC power source 16 whose electromotive force is EN1 [V] as the first voltage defining element. Or, as shown in FIG. 8B, it is possible to use a DC power source 17 whose electromotive force is EN2 [V] as the second voltage defining element.

Figure 9B:
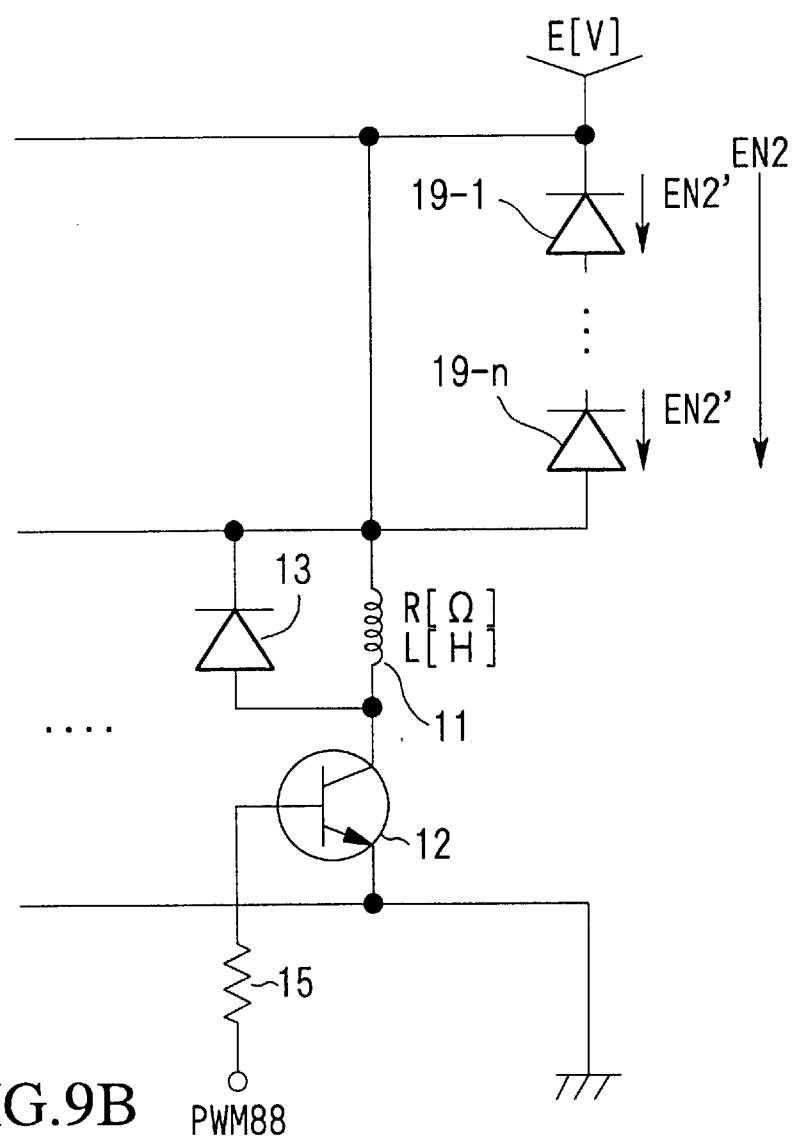
FIG. 9B is a circuit diagram showing a selected part of a solenoid driving circuit in accordance with a fourth modified example.
Figure 9A:
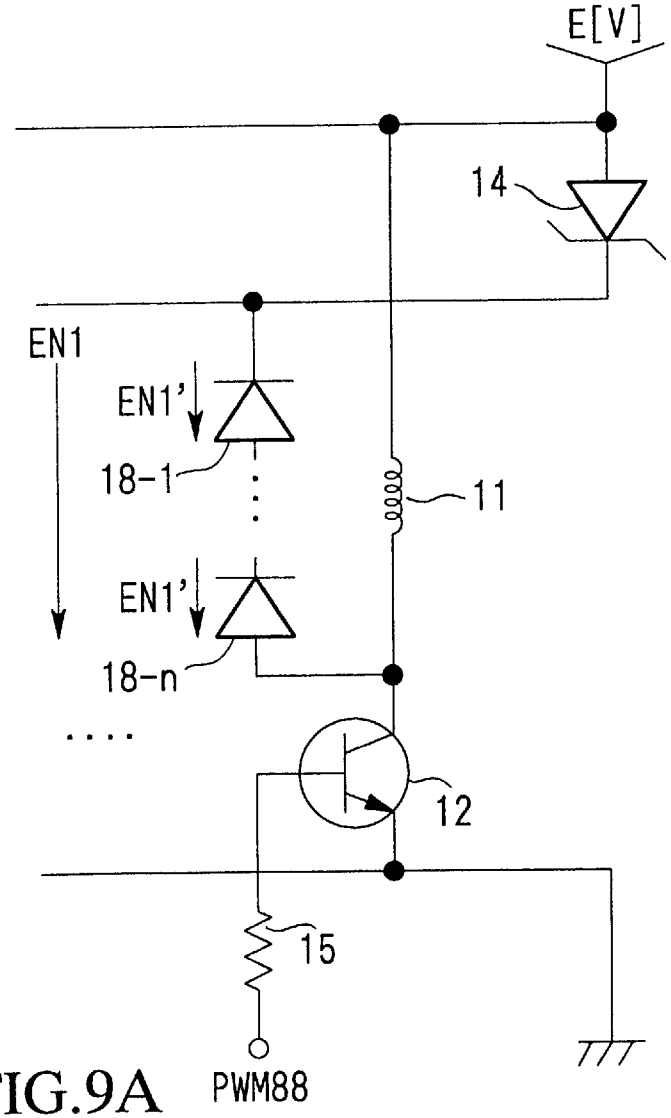
FIG. 9A is a circuit diagram showing a selected part of a solenoid driving circuit in accordance with a third modified example.
Figure 10:
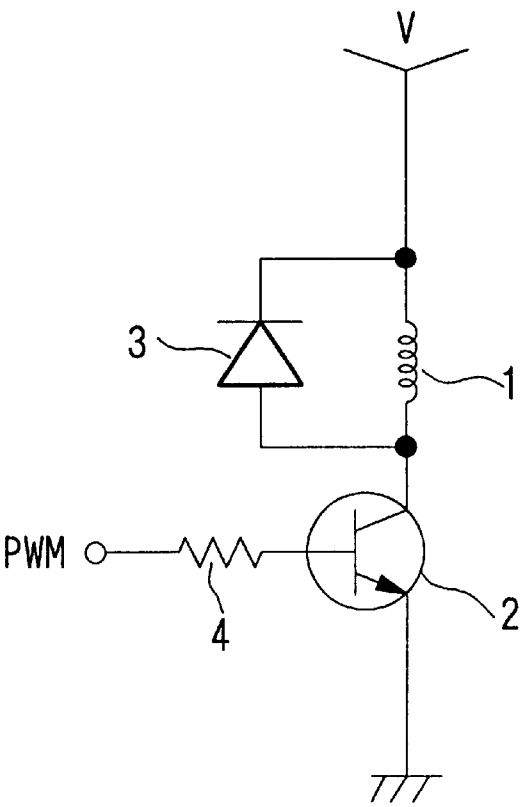
FIG. 10 is a circuit diagram showing an example of a conventional solenoid driving circuit using a single bridge circuit.
Figure 11:
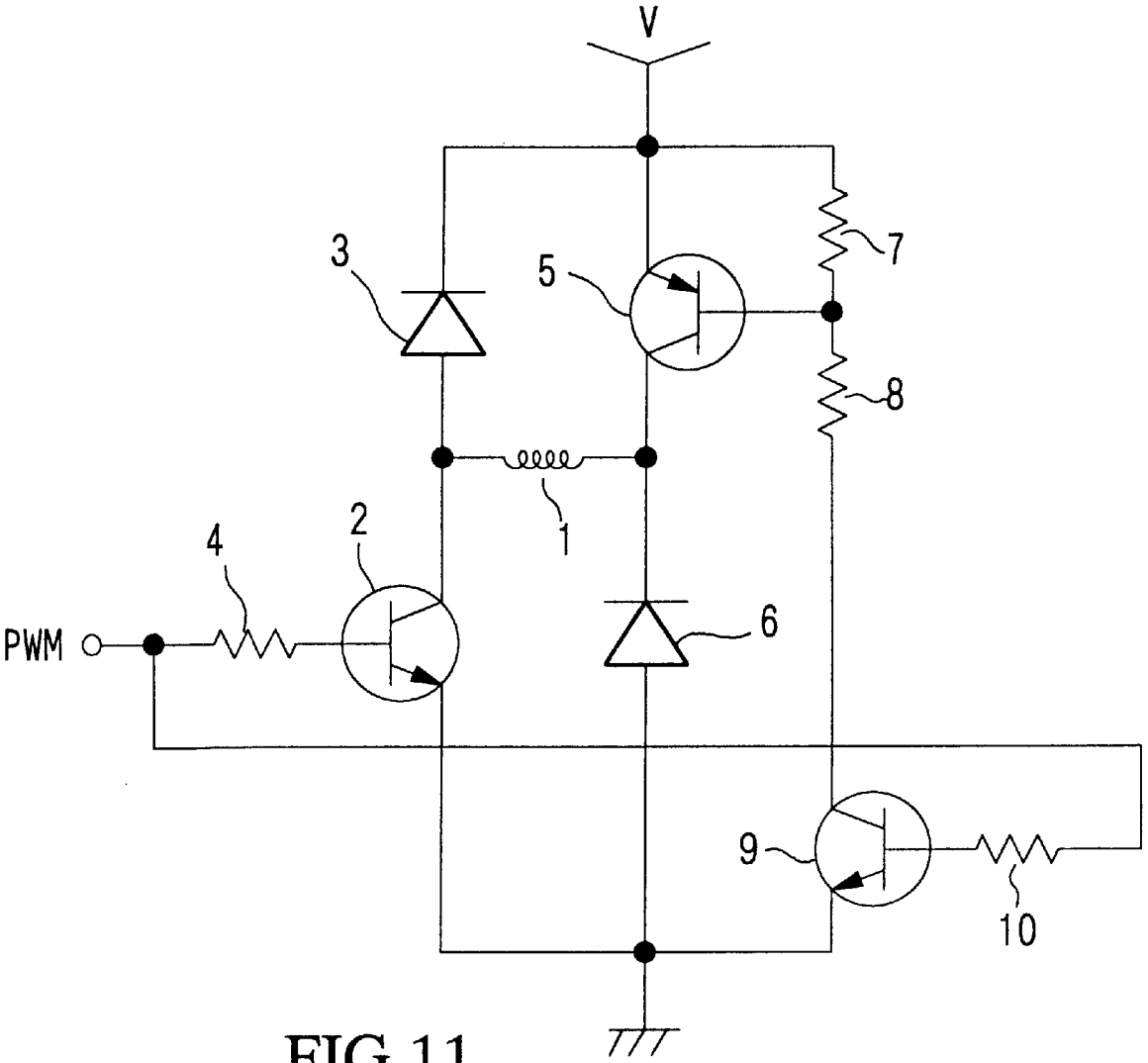
FIG. 11 is a circuit diagram showing an example of a conventional solenoid driving circuit using a full bridge circuit.

Moreover, as the first voltage defining element, it is possible to use a series circuit in which diodes 18-1 to 18-n are connected in series (see FIG. 9A), wherein each diode has forward voltage EN1' [V]. Or, as the second voltage defining element, it is possible to use a series circuit in which diodes 19-1 to 19-n are connected in series (see FIG. 9B), wherein each diode has forward voltage EN2' [V]. Herein, a numeral 'n' is an integer which is two or more. In addition, there are provided relationships represented by equations as follows:

$$n \times EN1' = EN1$$

$$n \times EN2 = EN2$$

If each diode is capable of producing EN1 or EN2, the diodes are not necessarily connected in series but can be connected in parallel.

In FIG. 1, it is possible to arbitrarily set a number of the keys (or a number of the solenoids) which the single zener diode 14 is capable of handling. That is, it is possible to provide multiple zener diodes for the keys of the player piano. If the keyboard of the player piano is divided into two sections, i.e., a low pitch section and a high pitch section, it is possible to provide two zener diodes. Herein, the reverse voltage (EN2) of the zener diode handling the low pitch section can differ from that of the zener diode handling the high pitch section. Of course, it is possible to provide an arbitrary combination in configurations of the zener diodes, kinds of elements and numbers of elements. The forward voltage (EN1) of the diode (13) provided for one solenoid (11) can differ from that of the diode provided for another solenoid.

Finally, the solenoid driving circuit of this invention can be redesigned in such a way that the voltage EN2 of the second voltage defining element (e.g., zener diode 14 and DC power source 17) is set at zero by the aforementioned design process. Further, the present embodiment merely shows an example of the procedures of the design for the parameters. Thus, it is possible to modify (or change) the procedures of the design in response to the required specification.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A solenoid driving circuit comprising:

a solenoid having a characteristic of a first-order low frequency filter, wherein a first end of the solenoid is connected to a DC power source;

switch means connected between a second end of the solenoid and ground, wherein the switch means switches over ground/non-ground states with respect to the second end of the solenoid in response to a drive signal which is subjected to pulse-width modulation, wherein the pulse-width modulation establishes a duty cycle corresponding to a target value of an average current that should flow across the solenoid;

first voltage defining means whose first end is connected to the second end of the solenoid, wherein if a potential at a second end of the first voltage defining means is lower than a potential at the second end of the solenoid by a first voltage or more, the first voltage defining means allows current given from the second end of the solenoid to pass therethrough; and second voltage defining means whose first end is connected to the second end of the first voltage defining means and operative during plural consecutive pulses of the pulse width modulation drive signal, wherein if a potential at a second end of the second voltage defining means is lower than a potential at the second end of the first voltage defining means by a second voltage or more, the second voltage defining means allows current given from the second end of the first voltage defining means to pass therethrough toward the DC power source, wherein using a first voltage EN1 of the first voltage defining means and a second voltage EN2 of the second voltage defining means, as well as a source voltage E of the DC power source and a time constant $\tau$ of the solenoid, an effective time constant of the solenoid is represented by $$-\ln\left(\frac{\frac{E}{e}+EN1+EN2}{E+EN1+EN2}\right)\cdot\tau$$

and the first voltage and the second voltage are set in such a way that the effective time constant of the solenoid is smaller than a maximum value of an operating frequency of an object which operates in response to a magnetic field produced by the solenoid.

2. A solenoid driving circuit according to claim 1 wherein the time constant $\tau$ of the solenoid, a frequency of the drive signal, the source voltage E of the DC power source, the first voltage EN1 and the second voltage EN2 are set in such a way that a current ripple amplitude caused by the drive signal is within a prescribed value, wherein the current ripple amplitude is represented by $$\frac{e^{\frac{T}{\tau}}-2e^{\frac{0.5T}{\tau}}+1}{e^{\frac{T}{\tau}}-1}\cdot\frac{E+EN1+EN2}{R}$$

where R is resistance of the solenoid and T is a period of the drive signal.

3. A solenoid driving circuit according to claim 1 wherein the object which operates in response to the magnetic field produced by the solenoid is a key of a player piano.

4. A solenoid driving circuit according to claim 1 wherein the first voltage defining means corresponds to a diode whose forward voltage corresponds to the first voltage while the second voltage defining means corresponds to a zener diode whose reverse voltage corresponds to the second voltage.

5. A solenoid driving circuit comprising:

a power source terminal for providing a source voltage E;

a solenoid having a characteristic of a first-order low frequency filter for producing a magnetic field to drive an object under a supply of the source voltage from the power source terminal;

a transistor switch which is switched over in response to a drive signal so as to allow or block a flow of current across the solenoid, wherein the drive signal is subjected to pulse-width modulation, wherein the pulse-width modulation establishes a duty cycle corresponding to a target value of an average current that should flow across the solenoid;

a first diode circuit having a first terminal connected to a connection between the solenoid and the transistor switch, wherein when the transistor switch is turned OFF, the first diode circuit allows current across the solenoid to flow therethrough if a potential difference applied to the first diode circuit is equivalent to a first voltage or more;

a second diode circuit operative during plural consecutive pulses of the pulse width modulation drive signal having a first terminal connected to the power source terminal while a second terminal thereof is connected to a second terminal of the first diode circuit, wherein if a potential difference applied to the second diode circuit is equivalent to a second voltage or more, the second diode circuit allows current across the first diode circuit to flow therethrough.

6. A solenoid driving circuit according to claim 5 wherein the object corresponds to a key of a player piano.

7. A solenoid driving circuit according to claim 5 wherein the transistor means corresponds to a NPN transistor in which a base receives the drive signal, a collector is connected to the solenoid, and an emitter is grounded.

8. A solenoid driving circuit according to claim 5 wherein the first diode means is a diode whose anode is connected to the connection between the solenoid and the transistor means so that the first voltage corresponds to forward voltage of the diode, while the second diode means is a zener diode whose anode is connected to the power source terminal and whose cathode is connected to a cathode of the diode so that the second voltage corresponds to reverse voltage of the zener diode.

9. A solenoid driving circuit according to claim 5 wherein using the source voltage E, a first voltage EN1 of the first diode circuit, a second voltage EN2 of the second diode circuit and a real time constant τ of the solenoid, an effective time constant of the solenoid is represented by $$-\ln\left(\frac{\frac{E}{e}+EN1+EN2}{E+EN1+EN2}\right)\cdot\tau$$

and is set at a value smaller than an operating frequency of the object driven by the solenoid, wherein the drive signal has a frequency set to exceed an audible frequency range while an amount of heating of the transistor means is under a product limit value.

10. A solenoid driving circuit according to claim 5 wherein using the source voltage E, a first voltage EN1 of the first diode circuit, a second voltage EN2 of the second diode circuit and a time constant τ of the solenoid as well as resistance R of the solenoid and a period T of the drive signal, a current ripple amplitude is represented by $$\frac{e^{\frac{T}{\tau}}-2e^{\frac{0.5T}{\tau}}+1}{e^{\frac{T}{\tau}}-1}\cdot\frac{E+EN1+EN2}{R}$$

and is set to be within a prescribed range in which mechanical noise is avoided.

11. A solenoid driving circuit according to claim 5 wherein using the source voltage E, a first voltage EN1 of the first diode circuit, a second voltage EN2 of the second diode circuit and a real time constant τ of the solenoid, an effective time constant of the solenoid is represented by $$-\ln\left(\frac{\frac{E}{e}+EN1+EN2}{E+EN1+EN2}\right)\cdot\tau$$

and is set at a value smaller than an action cutoff frequency of the object which corresponds to a key of a player piano, wherein the drive signal has a frequency set to exceed an audible frequency range while an amount of heating of the transistor means is under a product limit value.

* * * * *